US005682847A

United States Patent [19]

Hara

[11] Patent Number: 5,682,847

[45] Date of Patent: Nov. 4, 1997

[54] VALVE ACTUATING DEVICE FOR ENGINE

[75] Inventor: Seinosuke Hara, Atsugi, Japan

[73] Assignee: Unisia Jecs Corporation, Atsugi, Japan

[21] Appl. No.: 729,990

[22] Filed: Oct. 11, 1996

[30] Foreign Application Priority Data

Oct. 12, 1995 [JP] Japan ..... 7-264044

[51] Int. Cl.[6] ..... F01L 13/00; F01L 1/26

[52] U.S. Cl. ..... 123/90.16; 123/90.22; 123/90.39

[58] Field of Search ..... 123/90.15, 90.16, 123/90.17, 90.22, 90.27, 90.39, 90.4, 90.44, 90.45

[56] References Cited

U.S. PATENT DOCUMENTS

| | | | |
|---|---|---|---|
| 5,297,516 | 3/1994 | Hara | 123/90.16 |
| 5,452,694 | 9/1995 | Hara | 123/90.16 |
| 5,564,373 | 10/1996 | Hara | 123/90.16 |
| 5,570,664 | 11/1996 | Nohara | 123/90.16 |

FOREIGN PATENT DOCUMENTS 63-268908 11/1988 Japan .

*Primary Examiner*—Weilun Lo
*Attorney, Agent, or Firm*—Foley & Lardner

[57] ABSTRACT

A valve actuating device for an engine having first and second engine valves for each engine cylinder. The valve actuating device comprises first, second and third cams which have respectively first, second and third cam profiles which are different from each other. The first and second cam profiles are for a low engine speed range. The third cam profile is for a high engine speed range. First and second rocker arms are supported on a rocker shaft and swingable respectively in accordance with the first and second cam profiles and are adapted respectively to make valve movement actions of the first and second engine valves. A third rocker arm is supported on the rocker shaft and swingable in accordance with the third cam profile of the third cam. The third rocker arm is put into a first state to be simultaneously connected with the first and second rocker arms to serve as a single body, and a second state to be disconnected from the first and second rocker arms. Additionally, a connection mechanism is provided to put the third rocker arm into one of the first and second states, and includes a connection lever which is supported by the third rocker arm and swingable on a plane perpendicular to axis of the rocker shaft. A hydraulic pressure-operated driving device is provided to swingingly move the connection lever to engage with the engagement projections under hydraulic pressure. A lever restoring device is disposed in the third rocker arm to swingingly move the connection lever in a direction to put the third rocker arm into the second state.

8 Claims, 2 Drawing Sheets

VALVE ACTUATING DEVICE FOR ENGINE

BACKGROUND OF THE INVENTION

1. Field of the Invention

This invention relates to improvements in a valve actuating device for an engine, and more particularly to such a valve actuating device which is arranged such that valve lift characteristics of engine valves are changed over when engine operation is changed from a low engine speed range to a high engine speed range and vice versa.

2. Description of the Prior Art

Hitherto a variety of valve actuating mechanisms for varying valve actuating characteristics of intake or exhaust valves of an internal combustion engine have been proposed and put into practical use. Typical one of them is arranged as follows: A cam for a low engine speed range and another cam for a high engine speed range are provided to actuate two intake valves and/or two exhaust valves for each engine cylinder of the engine. In the high engine speed range, two rocker arms driven by the cams are connected with each other, for example, under the action of a hydraulic pressure driving mechanism and put into a state to be driven by the cam for the high engine speed range, so that the intake or exhaust valves are actuated in the valve timings and/or the valve lifts corresponding to the high engine speed range.

An example of such a conventional valve actuating mechanism is disclosed in Japanese Patent Provisional Publication No. 63-268908, in which two rocker arms for the low engine speed range are swingably mounted on a rocker shaft and disposed to connect two intake valves for each engine cylinder to two cams for the low engine speed range which cams are formed on a camshaft. Additionally, a cam for the high engine speed range is disposed between the rocker arms for the low engine speed range and arranged to be driven by a cam for the high engine speed range. In the high engine speed range, connection pins are projected from the rocker arm for the high engine speed range into the rocker arms for the low engine speed range in a direction parallel with the rocker shaft under influence of hydraulic pressure supplied from a hydraulic fluid passage formed as a hollow of the rocker shaft, so that the three rocker arms are integrally connected to serve as a single body. When engine operation shifts from the high engine speed range to the low engine speed range, supply of the hydraulic pressure to be applied to the connection pin is stopped so that the connection pin is withdrawn toward the rocker arm for the high engine speed range under the action of a return spring thereby releasing the connected state of the three rocker arms.

However, drawbacks have been encountered in the above conventional valve actuating mechanism, as discussed below. In the conventional valve actuating mechanism, both the rocker arms for the high and low engine speed ranges are formed with guide holes for the connection pins, in which a direction of extension of the guide holes is parallel with the rocker shaft. Accordingly, a high machining technique is required to form the guide holes of the three rocker arms because the guide holes are to be high in precision of relative location relationship. This unavoidably raises production cost of the valve actuating mechanism. More specifically, the connecting action by the connection pins are taken place when the rocker arm is on the base circle of the cam in which no cam lift occurs. Even under this condition, an end of the rocker arm for the high engine speed range is kept at a state to be biased to the cam under the action of a lash adjuster, and therefore the three guide holes of the three rocker arms are difficult to come into coincidence with each other. If the three guide holes are not brought into coincidence with each other, the connected state of the three rocker arms cannot be obtained. In this regard, it is assumed to enlarge the diameter of each of three guide holes, however, this reduces a contacting area of each connection pin to an inner wall surface defining the guide hole and raises a contacting surface pressure of the connection pin, while generating a one-sided load of the connection pin in the contacting state. These increases the tendency of the connection pins making their wear.

SUMMARY OF THE INVENTION

An object of the present invention is to provide an improved valve actuating device for an engine, which effectively overcomes drawbacks encountered in conventional valve actuating mechanisms of the type including two rocker arms for a low engine speed range and a rocker arm for a high engine speed range.

Another object of the present invention is to provide an improved valve actuating device for an engine, which can accomplish a stable change-over action between valve actuating states in accordance with engine speed ranges, and is low in possibility of making troubles, while being easy in assembly operations.

A valve actuating device of the present invention is for an engine having first and second engine valves for each engine cylinder. The valve actuating device comprises first, second and third cams which have respectively first, second and third cam profiles which are different from each other. The first and second cam profiles are for a first engine operating condition. The third cam profile is for a second engine operating condition. First and second rocker arms are supported on a rocker shaft and swingable respectively in accordance with the first and second cam profiles of the first and second cams. The first and second rocker arms are adapted respectively to make valve movement actions of the first and second engine valves in accordance with the first and second cam profiles. A third rocker arm is supported on the rocker shaft and swingable in accordance with the third cam profile of the third cam. The third rocker arm is adapted to make a valve movement action of the first and second engine valves in accordance with the cam profile of the third cam. The third rocker arm is put into a first state to be simultaneously connected with the first and second rocker arms to serve as a single body, and a second state to be disconnected from the first and second rocker arms. Additionally, a connection mechanism is provided to put the third rocker arm into one of the first and second states, and includes a connection lever which is supported by the third rocker arm and swingable on a plane perpendicular to axis of the rocker shaft. An engagement projection is formed on each of the first and second rocker arms, in which a first end portion of the connection lever being engageable with the engagement projection. A hydraulic pressure-operated driving device is provided to swingingly-move the connection lever to cause the first end portion of the connection lever to engage with the engagement projections under hydraulic pressure so that the third rocker arm is put into the first state. A lever restoring device is disposed in the third rocker arm .to swingingly move the connection lever arm in a direction to put the third rocker arm into the second state.

According to the valve actuating device of the present invention, connection or disconnection between the first and second rocker arms relating to valve actuating action for the first engine operating condition and the third rocker arm relating to valve actuating action for the second engine operating condition can be accomplished by swingingly moving the third rocker arm on the plane perpendicular to the rocker shaft under the influence of hydraulic pressure introduced to the third rocker arm. This is different from the conventional valve actuating mechanism which accomplishes such connection and disconnection under the action of the connection pins and the guide holes, and therefore does not requires a high machining precision for forming the connection pins and the guide holes. Additionally, a high precision of locational relationship between the rocker arms can be obtained by assembling the connection lever, and therefore the machining precision of the rocker arms and the lever(s) can be lowered thereby achieving a production cost reduction of the valve actuating device. Further, the connected state of the three rocker arms can be obtained by causing the end portion of the connection lever to be brought into engagement with the engagement projections of the first and second rocker arms. As a result, a contacting surface pressure between the connection lever and the rocker arms can be lowered thereby improving a wear resistance of the connection mechanism. Furthermore, the arrangement of the valve actuating device of the present invention renders it easy to make the assembling operation and adjustment for supporting the connection lever on the third rocker arm.

DETAILED DESCRIPTION OF THE INVENTION

Figure 1:
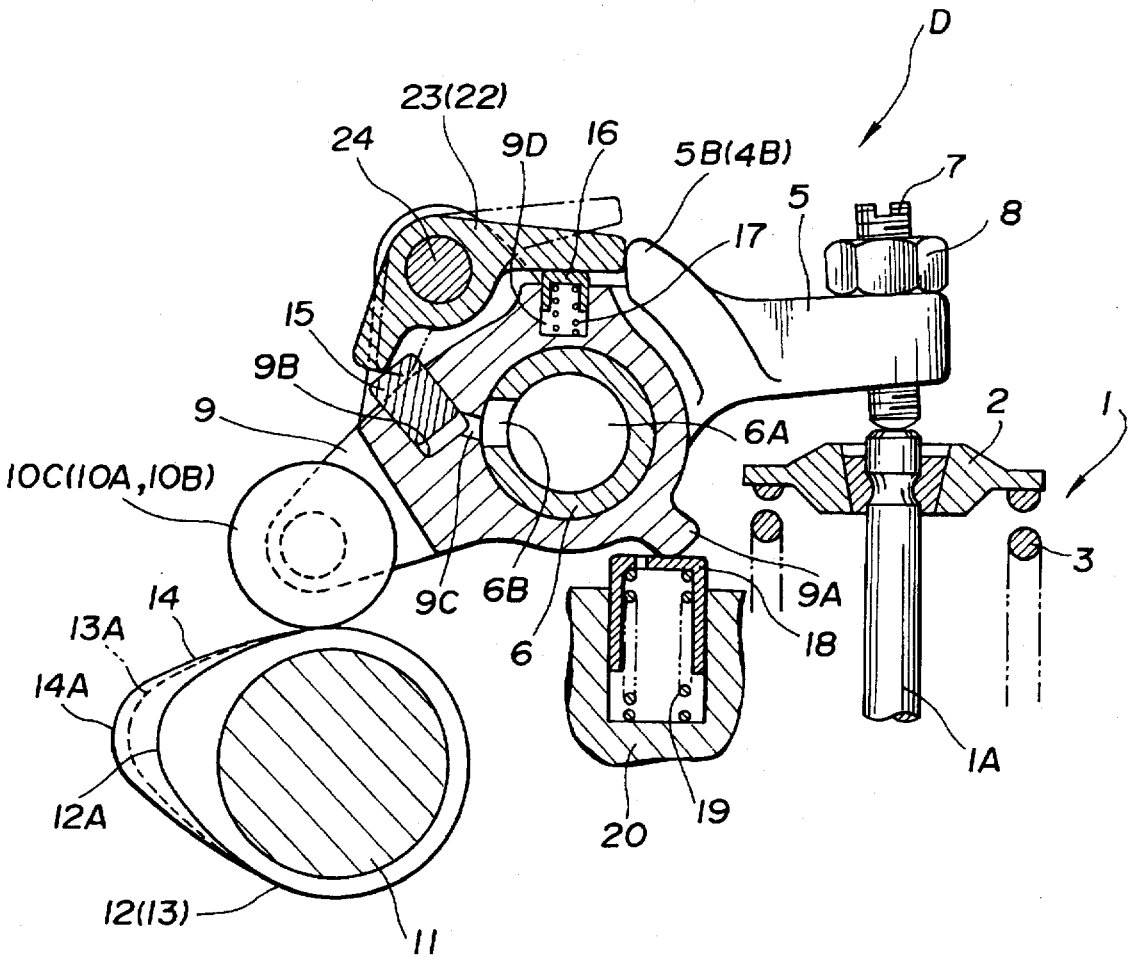
FIG. 1 is a side view, partly in section, of an embodiment of a valve actuating device according to the present invention.
Figure 2:
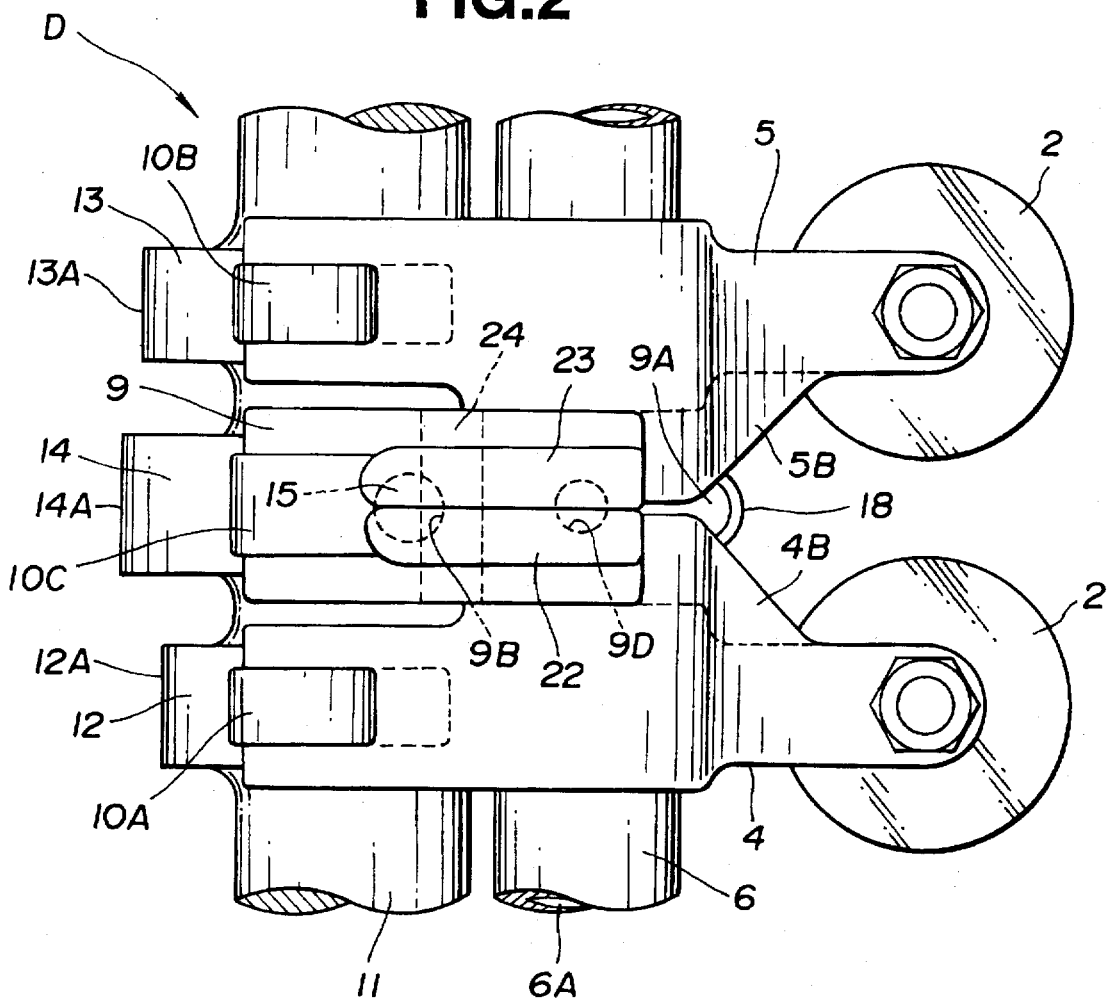
FIG. 2 is a plan view of the valve actuating device of FIG. 1.

Referring now to FIGS. 1 and 2, an embodiment of a valve actuating device for an internal combustion engine, according to the present invention is illustrated by the reference numeral D. In this embodiment, the engine has two intake valve 1, 1 and two exhaust valve (not shown). Each intake valve 1 includes a valve stem 1A which is securely supported by a retainer 2 which is biased by a valve spring 3.

The valve actuating device D comprises side rocker arms 4, 5 which are swingably pivotally supported on a rocker shaft 6 and function at a low engine speed range. Each side rocker arm 4, 5 is provided at its valve side end section with an adjustment screw 7 and an adjustment nut 8 for adjusting a valve clearance as shown in FIG. 1. A center rocker arm 9 is disposed between the side rocker arms 4, 5 and arranged to function at a low engine speed range. The central rocker arm 9 is also swingably pivotally mounted on the rocker shaft 6.

Roller (cam) followers 10A, 10B, 10C are respectively rotatably supported at cam shaft side end sections of the rocker arms 4, 5, 9. As shown in FIG. 1, the center rocker arm 9 is formed at its central section with a projection 9A which projects generally downward from the lower surface thereof. The center rocker arm 9 is formed at its central section with a hydraulic pressure supply chamber 9B and a return plunger chamber 9D which are formed to open to the upper surface thereof. The hydraulic pressure supply chamber 9B is located one-sided to the cam shaft side end section of the center rocker arm 9, whereas the return plunger chamber 9D is located one-sided to the valve side end section of the center rocker arm 9. Additionally, a hydraulic pressure supply passage 9C is formed in the center rocker arm 9 in a manner to establish-communication between the hydraulic pressure supply chamber 9B and a hydraulic fluid (oil) passage 6A or hollow formed in the rocker shaft 6.

A cam shaft 11 is provided with cams 12, 13 whose cam profiles are arranged to function at the high engine speed range, and a cam 14 whose cam profile is arranged to function at the low engine speed range. The cams 12, 13, 14 have respectively cam lobes 12A, 13A, 14A each of which has a top surface which is arcuate in section, in which each roller follower 10A, 10B, 10C is in slidable contact with the top surface of the corresponding cam lobe.

Figure 3:
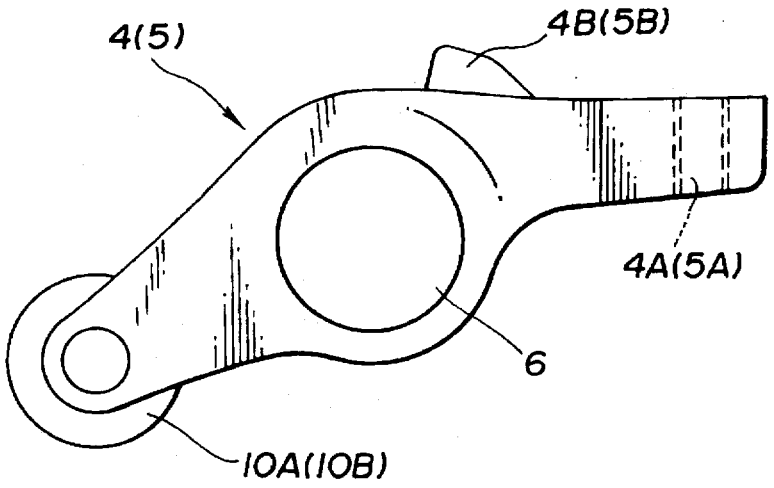
FIG. 3 is a side view of a rocker arm shown by being taken out from the valve actuating device of FIG. 1.

For the purpose of simplicity of illustration, one of the side rocker arms 4, 5 for the low engine speed range is taken out and illustrated in FIG. 3. Here, the side rocker arm 4(5) is formed at its valve side end section with a threaded hole 4A(4B) for an adjustment screw 7. The side rocker arm 4(5) is provided at its central section with an engagement projection 4B(5B) which projects upwardly from the upper surface thereof. The function of the engagement projection 4B(5B) will be discussed after.

Hereinafter, discussion will be made on a mechanism by which connection is established and released between the side rocker arms 4, 5 and the center rocker arm 9.

A piston member 15 is slidably disposed in the hydraulic pressure chamber 9B of the center rocker arm 9. A return plunger 16 is slidably disposed in the return plunger chamber 9D of the center rocker arm 9. A return spring 17 is disposed in the return plunger chamber 9D to upwardly bias the return plunger 16. A plunger 18 is slidably disposed in a plunger chamber (no numeral) formed in a cylinder head 20 of the engine. The plunger 18 is in contact with the projection 9A of the center rocker arm 9 so as to bias the center rocker arm 9 counterclockwise around the rocker shaft 6, so that the roller follower 10C is pushed on the cam surface of the cam 14 for the high engine speed range.

Connection levers 22, 23 are respectively swingably pivotally mounted on a lever shaft 24 connected to the center rocker arm 9 in a manner that they are located parallel with each other, as shown in FIG. 2. The connection levers 22, 23 are located over the single piston member 15 so as to be simultaneously driven by the piston member 15 in the hydraulic pressure supply chamber 9B. Additionally, the connection levers 22, 23 are located over the single return plunger 16 so as to be simultaneously biased to take a position indicated by dot-dot-dash lines in FIG. 1 under the action of the return spring 17. The rocker shaft 6 is formed with a hydraulic fluid passage 6B through which the hydraulic fluid or pressure in the hydraulic fluid passage 6A is supplied to the hydraulic fluid passage 9C in the center rocker arm 9.

A manner of operation of the above valve actuating device D of this embodiment will be discussed below.

In this embodiment, the valve lift characteristics of the intake valves 1, 1 obtained respectively under the action of the cams 12, 13 for the low engine speed ranges are different from each other, in which a swirl of intake air is developed in the engine cylinder of the engine under the effects of the different valve lift characteristics of the two intake valves 1, 1 thereby improving combustion in the engine cylinder at the low engine speed range.

When engine operation is in the low engine speed range, the hydraulic fluid pressure chamber 9B has not been supplied with the hydraulic pressure, and therefore the piston member 15 is not put into a projecting state shown in FIG. 1. As a result, the both connection levers 22, 23 are kept at the position indicated by the dot-dot-dash line in FIG. 1, so that the connection levers 22, 23 are not respectively brought into engagement with the engagement projections 4B, 5B of the side rocker arms 4, 5. Accordingly, the side rocker arms 4, 5 are independently and freely swingable around the rocker shaft 6 in conformity with the respective cam surfaces of the cams 12, 13. Thus, the intake valves 1, 1 are actuated respectively at valve timings set to be suitable for engine operation at the low engine speed range, thereby improving a combustion efficiency of the engine.

When engine operation is shifted from the low engine speed range to the high engine speed range, an electromagnetically operated change-over valve (not shown) is operated under the action of a control system (not shown) so as to supply the hydraulic fluid pressure from the oil passage 6A to the hydraulic pressure supply chamber 9B through the hydraulic pressure supply passage 9C and the hydraulic pressure supply passage 9C formed in the center rocker arm 9. Accordingly, the piston member 15 projects from the hydraulic pressure supply chamber 9B so as to cause the connection levers 22, 23 to rotate clockwise around the lever shaft 24 in FIG. 1. As a result, the valve side tip end portions of the connection levers 22, 23 are respectively brought into engagement with the engagement projections 4B, 5B of the side rocker arms 4, 5 for the low engine speed range, in which the connection levers 22, 23 take a position indicated by solid lines in FIG. 1. Thus, under such an engagement state of the connection levers 22, 23, the side rocker arms 4, 5 are brought into connection with the center rocker arm 9 20 so as to serve as a single integrated body, so that movement (due to the cam surface of the cam for the high engine speed range) of the center rocker arm 9 is transmitted through the side rocker arms 4, 5 to the intake valves 1, 1. As a result, the intake valves make their valve lift suitable for the high engine speed range.

When engine operation shifts from the high engine speed range to the low engine speed range, supply of hydraulic pressure to the hydraulic pressure supply chamber 9B is stopped, and therefore the piston member 15 is withdrawn into the hydraulic pressure chamber 9B while the return plunger 16 projects under the action of the return spring 17. This releases the engagement of the connection levers 22, 23 to the engagement projections 4B, 5B of the side rocker arms 4, 5. Accordingly, the swinging movement (due to the cam 14 for the high engine speed range) of the center rocker arm 9 cannot be transmitted to the side rocker arms 4, 5. Thus, the intake valves 1, 1 are actuated under the action of the cams 4, 5 for the low engine speed range, and therefore make their valve operation at the valve lifts and valve timings which have been previously set for the low engine speed range.

While the valve actuating device of the above embodiment has been shown and described as being arranged to actuate the .two intake valves of the engine of the type wherein two intake valves is used for each engine cylinder, it will be understood that the principle of the present invention may be applicable, for example, to two exhaust valves of an engine of the type wherein two exhaust valves are used for each engine cylinder, or two intake and exhaust valves of an engine of the type wherein two intake and exhaust valves are used in each engine cylinder, in which the valve timings and valve lefts of the two valves are different from each other.

In the above embodiment, the connection levers 22, 23 have been shown and described as being rotatably supported on the lever shaft 24, in which the side rocker arms 4, 5 are brought into engagement with or released in engagement from the center rocker arm 9 under the action of the single piston member 15 which makes its projection and withdrawal actions. This makes it possible to obtain a high precision in relative locational relationship between the rocker arm 9 and the rocker arms 4, 5 by selecting and assembling two connection levers 22, 23. However, it may be possible that the connection levers 22, 23 are replaced with a single connection lever (not shown), in which a high control precision will not be obtained as compared with a case using the two connection levers; however, a high relative locational relationship precision between the rocker arm 9 and the rocker arms 4, 5 can be obtained while reducing the number of levers to be used in a valve actuating device.

What is claimed is:

1. A valve actuating device for an engine having first and second engine valves for each engine cylinder, comprising:

first, second and third cams .which have respectively first, second and third cam profiles which are different from each-other, the first and second cam profiles being for a first engine operating condition, the third cam profile being for a second engine operating condition;

first and second rocker arms supported on a rocker shaft and being swingable respectively in accordance with the first and second cam profiles of the first and second cams, said first and second rocker arms being adapted respectively to make valve movement actions of the first and second engine valves in accordance with the first and second cam profiles;

a third rocker arm supported on the rocker shaft and being swingable in accordance with the third cam profile of the third cam, said third rocker arm being adapted to make a valve movement action of the first and second engine valves in accordance with the cam profile of the third cam, said third rocker arm being put into a first state to be simultaneously connected with said first and second rocker arms to serve as a single body, and a second state to be disconnected from the first and second rocker arms; and a connection mechanism for putting said third rocker arm into one of the first and second states, said connecting mechanism including a connection lever which is supported by said third rocker arm and swingable on a plane perpendicular to axis of the rocker shaft, an engagement projection formed on each of said first and second rocker arms, a first end portion of said connection lever being engageable with said engagement projections, hydraulic pressure-operated driving means for swingingly moving said connection lever to cause the first end portion of said connection lever to engage with said engagement projections under hydraulic pressure so that said third rocker arm is put into the first state, and lever restoring means disposed in said third rocker arm to swingingly move said connection lever in a direction to put said third rocker arm into the second state.

2. A valve actuating device as claimed in claim 1, wherein said hydraulic pressure-operated driving means includes a piston member movably disposed in a chamber formed in said third rocker arm, said piston member being capable of biasing a second end portion of said connection lever to swingingly move said connection lever.

3. A valve actuating device as claimed in claim 1, wherein the first and second engine valves are first and second intake valves for each engine cylinder.

4. A valve actuating device as claimed in claim 1, wherein said first engine operating condition is in a low engine speed range, and said second engine operating condition is in a high engine speed range higher in engine speed than the low engine speed range.

5. A valve actuating device as claimed in claim 1, wherein said first and second cams are arranged to cause the first and second engine valves to respectively make first and second valve lifts which are different from each other.

6. A valve actuating device as claimed in claim 2, wherein said third rocker arm is disposed between said first and second rocker arms.

7. A valve actuating device as claimed in claim 6, wherein said connection lever includes first and second levers which are located parallel with each other and independently movable to be respectively engageable with the engagement projections of said first and second rocker arms, each of first and second levers having a first end portion engageable with the engagement projection of said corresponding rocker arms, and a second end portion opposite to the first end portion.

8. A valve actuating device as claimed in claim 7, wherein said piston member is located to simultaneously bias the second end portions of said first and second levers.

* * * * *